US007474861B2

(12) United States Patent
Hamby et al.

(10) Patent No.: US 7,474,861 B2
(45) Date of Patent: Jan. 6, 2009

(54) CONSUMABLE SELECTION IN A PRINTING SYSTEM

(75) Inventors: Eric Scott Hamby, Fairport, NY (US); Robert M. Lofthus, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 332 days.

(21) Appl. No.: 11/215,791

(22) Filed: Aug. 30, 2005

(65) Prior Publication Data

US 2007/0047976 A1 Mar. 1, 2007

(51) Int. Cl.
*G03G 15/00* (2006.01)

(52) U.S. Cl. ..... 399/12

(58) Field of Classification Search ..... 399/12, 399/24, 25, 27, 28, 29, 262, 38, 46, 49, 50, 399/51, 53, 66, 67, 71

See application file for complete search history.

(56) References Cited

U.S. PATENT DOCUMENTS

| | | | |
|---|---|---|---|
| 4,579,446 | A | 4/1986 | Fujino et al. |
| 4,587,532 | A | 5/1986 | Asano |
| 4,836,119 | A | 6/1989 | Siraco et al. |
| 5,004,222 | A | 4/1991 | Dobashi |
| 5,080,340 | A | 1/1992 | Hacknauer et al. |
| 5,095,342 | A | 3/1992 | Farrell et al. |
| 5,159,395 | A | 10/1992 | Farrell et al. |
| 5,208,640 | A | 5/1993 | Horie et al. |
| 5,272,511 | A | 12/1993 | Conrad et al. |
| 5,326,093 | A | 7/1994 | Sollitt |
| 5,435,544 | A | 7/1995 | Mandel |
| 5,473,419 | A | 12/1995 | Russel et al. |
| 5,489,969 | A | 2/1996 | Soler et al. |
| 5,504,568 | A | 4/1996 | Saraswat et al. |
| 5,525,031 | A | 6/1996 | Fox |
| 5,557,367 | A | 9/1996 | Yang et al. |
| 5,568,246 | A | 10/1996 | Keller et al. |
| 5,570,172 | A | 10/1996 | Acquaviva |
| 5,596,416 | A | 1/1997 | Barry et al. |
| 5,629,762 | A | 5/1997 | Mahoney et al. |

(Continued)

FOREIGN PATENT DOCUMENTS

JP 2003084631 A * 3/2003

(Continued)

OTHER PUBLICATIONS

Morgan, P.F., "Integration of Black Only and Color Printers", Xerox Disclosure Journal, vol. 16, No. 6, Nov./Dec. 1991, pp. 381-383.

(Continued)

*Primary Examiner*—Robert Beatty
(74) *Attorney, Agent, or Firm*—Eugene O. Palazzo; Fay Sharpe LLP

(57) ABSTRACT

A marking engine includes a plurality of components which each perform a portion of a marking operation. A processing component receives information on a replacement module, such as a toner cartridge selected from a set of different toner carridges, which is to be incorporated into the marking engine. The processing component determines, for one or more of the components of the marking engine, appropriate adjustments for rendering the marking engine compatible with the replacement module, based on the received information.

23 Claims, 4 Drawing Sheets

U.S. PATENT DOCUMENTS

| | | | | |
|---|---|---|---|---|
| 5,710,968 | A | 1/1998 | Clark et al. | |
| 5,778,377 | A | 7/1998 | Marlin et al. | |
| 5,884,910 | A | 3/1999 | Mandel | |
| 5,995,721 | A | 11/1999 | Rourke et al. | |
| 6,016,409 | A | 1/2000 | Beard et al. | |
| 6,059,284 | A | 5/2000 | Wolf et al. | |
| 6,125,248 | A | 9/2000 | Moser | |
| 6,241,242 | B1 | 6/2001 | Munro | |
| 6,297,886 | B1 | 10/2001 | Cornell | |
| 6,301,449 | B1 * | 10/2001 | Miura | 399/12 |
| 6,341,773 | B1 | 1/2002 | Aprato et al. | |
| 6,363,226 | B1 * | 3/2002 | Batori | 399/8 |
| 6,384,918 | B1 | 5/2002 | Hubble, III et al. | |
| 6,450,711 | B1 | 9/2002 | Conrow | |
| 6,476,376 | B1 | 11/2002 | Biegelsen et al. | |
| 6,476,923 | B1 | 11/2002 | Cornell | |
| 6,493,098 | B1 | 12/2002 | Cornell | |
| 6,532,351 | B2 | 3/2003 | Richards et al. | |
| 6,537,910 | B1 | 3/2003 | Burke et al. | |
| 6,550,762 | B2 | 4/2003 | Stoll | |
| 6,554,276 | B2 | 4/2003 | Jackson et al. | |
| 6,577,925 | B1 | 6/2003 | Fromherz | |
| 6,607,320 | B2 | 8/2003 | Bobrow et al. | |
| 6,608,988 | B2 | 8/2003 | Conrow | |
| 6,612,566 | B2 | 9/2003 | Stoll | |
| 6,612,571 | B2 | 9/2003 | Rider | |
| 6,621,576 | B2 | 9/2003 | Tandon et al. | |
| 6,633,382 | B2 | 10/2003 | Hubble, III et al. | |
| 6,639,669 | B2 | 10/2003 | Hubble, III et al. | |
| 6,711,362 | B2 * | 3/2004 | Asakura | 399/12 |
| 6,819,906 | B1 | 11/2004 | Herrmann et al. | |
| 6,865,349 | B2 * | 3/2005 | Silence et al. | 399/8 |
| 6,895,191 | B2 | 5/2005 | Rommelmann et al. | |
| 2002/0078012 | A1 | 6/2002 | Ryan et al. | |
| 2002/0103559 | A1 | 8/2002 | Gartstein | |
| 2003/0077095 | A1 | 4/2003 | Conrow | |
| 2004/0085561 | A1 | 5/2004 | Fromherz | |
| 2004/0085562 | A1 | 5/2004 | Fromherz | |
| 2004/0088207 | A1 | 5/2004 | Fromherz | |
| 2004/0150156 | A1 | 8/2004 | Fromherz et al. | |
| 2004/0150158 | A1 | 8/2004 | Biegelsen et al. | |
| 2004/0153983 | A1 | 8/2004 | McMillan | |
| 2004/0216002 | A1 | 10/2004 | Fromherz et al. | |
| 2004/0225391 | A1 | 11/2004 | Fromherz et al. | |
| 2004/0225394 | A1 | 11/2004 | Fromherz et al. | |
| 2004/0247365 | A1 | 12/2004 | Lofthus et al. | |

FOREIGN PATENT DOCUMENTS

JP 2003162187 A * 6/2003

OTHER PUBLICATIONS

Desmond Fretz, "Cluster Printing Solution Announced", Today at Xerox (TAX), No. 1129, Aug. 3, 2001.
U.S. Appl. No. 10/761,522, filed Jan. 21, 2004, Mandel et al.
U.S. Appl. No. 10/785,211, filed Feb. 24, 2004, Lofthus et al.
U.S. Appl. No. 10/881,619, filed Jun. 30, 2004, Bobrow.
U.S. Appl. No. 10/917,676, filed Aug. 13, 2004, Lofthus et al.
U.S. Appl. No. 10/917,768, filed Aug. 13, 2004, Lofthus et al.
U.S. Appl. No. 10/924,106, filed Aug. 23, 2004, Lofthus et al.
U.S. Appl. No. 10/924,113, filed Aug. 23, 2004, deJong et al.
U.S. Appl. No. 10/924,458, filed Aug. 23, 2004, Lofthus et al.
U.S. Appl. No. 10/924,459, filed Aug. 23, 2004, Mandel et al.
U.S. Appl. No. 10/933,556, filed Sep. 3, 2004, Spencer et al.
U.S. Appl. No. 10/953,953, filed Sep. 29, 2004, Radulski et al.
U.S. Appl. No. 10/999,326, filed Nov. 30, 2004, Grace et al.
U.S. Appl. No. 10/999,450, filed Nov. 30, 2004, Lofthus et al.
U.S. Appl. No. 11/000,158, filed Nov. 30, 2004, Roof.
U.S. Appl. No. 11/000,168, filed Nov. 30, 2004, Biegelsen et al.
U.S. Appl. No. 11/000,258, filed Nov. 30, 2004, Roof.
U.S. Appl. No. 11/001,890, filed Dec. 2, 2004, Lofthus et al.
U.S. Appl. No. 11/002,528, filed Dec. 2, 2004, Lofthus et al.
U.S. Appl. No. 11/051,817, filed Feb. 4, 2005, Moore et al.
U.S. Appl. No. 11/070,681, filed Mar. 2, 2005, Viturro et al.
U.S. Appl. No. 11/081,473, filed Mar. 16, 2005, Moore.
U.S. Appl. No. 11/069,020, filed Feb. 28, 2005, Lofthus et al.
U.S. Appl. No. 11/089,854, filed Mar. 25, 2005, Clark et al.
U.S. Appl. No. 11/090,498, filed Mar. 25, 2005, Clark.
U.S. Appl. No. 11/090,502, filed Mar. 25, 2005, Mongeon.
U.S. Appl. No. 11/095,378, filed Mar. 31, 2005, Moore et al.
U.S. Appl. No. 11/094,998, filed Mar. 31, 2005, Moore et al.
U.S. Appl. No. 11/094,864, filed Mar. 31, 2005, de Jong et al.
U.S. Appl. No. 11/095,872, filed Mar. 31, 2005, Julien et al.
U.S. Appl. No. 11/102,355, filed Apr. 8, 2005, Fromherz et al.
U.S. Appl. No. 11/084,280, filed Mar. 18, 2005, Mizes.
U.S. Appl. No. 11/109,566, filed Apr. 19, 2005, Mandel et al.
U.S. Appl. No. 11/109,558, filed Apr. 19, 2005, Furst et al.
U.S. Appl. No. 11/109,996, filed Apr. 20, 2005, Mongeon et al.
U.S. Appl. No. 11/093,229, filed Mar. 29, 2005, Julien.
U.S. Appl. No. 11/102,899, filed Apr. 8, 2005, Crawford et al.
U.S. Appl. No. 11/102,910, filed Apr. 8, 2005, Crawford et al.
U.S. Appl. No. 11/115,766, filed Apr. 27, 2005, Grace.
U.S. Appl. No. 11/102,332, filed Apr. 8, 2005, Hindi et al.
U.S. Appl. No. 11/136,959, filed May 25, 2005, German et al.
U.S. Appl. No. 11/136,821, filed May 25, 2005, Robinson.
U.S. Appl. No. 11/122,420, filed May 5, 2005, Richards.
U.S. Appl. No. 11/137,634, filed May 25, 2005, Lofthus et al.
U.S. Appl. No. 11/137,251, filed May 25, 2005, Lofthus et al.
U.S. Appl. No. 11/137,273, filed May 25, 2005, Anderson et al.
U.S. Appl. No. 11/152,275, filed Jun. 14, 2005, Roof et al.
U.S. Appl. No. 11/156,778, filed Jun. 20, 2005, Swift.
U.S. Appl. No. 11/157,598, filed Jun. 21, 2005, Frankel.
U.S. Appl. No. 11/143,818, filed Jun. 2, 2005, Dalai et al.
U.S. Appl. No. 11/146,665, filed Jun. 7, 2005, Mongeon.
U.S. Appl. No. 11/166,299, filed Jun. 24, 2005, Moore.
U.S. Appl. No. 11/166,460, filed Jun. 24, 2005, Roof et al.
U.S. Appl. No. 11/166,581, filed Jun. 24, 2005, Lang et al.
U.S. Appl. No. 11/166,763, filed Jun. 24, 2005, Thayer.
U.S. Appl. No. 11/166,961, filed Jun. 24, 2005, Moore.
U.S. Appl. No. 11/170,873, filed Jun. 30, 2005, Klassen.
U.S. Appl. No. 11/170,975, filed Jun. 30, 2005, Klassen.
U.S. Appl. No. 11/168,152, filed Jun. 28, 2005, German et al.
U.S. Appl. No. 11/189,371, filed Jul. 26, 2005, Moore et al.

* cited by examiner

CONSUMABLE SELECTION IN A PRINTING SYSTEM

BACKGROUND

The exemplary embodiment relates to the printing arts. It finds particular application in connection with matching of consumables, such as toners, to a marking engine in a printing system comprising multiple marking engines and will be described with particular reference thereto. However, it will be appreciated that the exemplary embodiment finds application in single marking engine printing systems.

Electronic printing systems typically employ an input terminal which receives images in digital form and conversion electronics for converting the image to image signals or pixels. The printing system may include a scanner for scanning image-bearing documents or be connected to a computer network which supplies the digital images. The signals are stored and are read out successively to a marking engine for formation of the images and transfer of the images to a print medium, such as paper. Printing systems have been developed which employ multiple marking engines for black, process (or full) color, and custom color (single color or monochrome) printing of selected pages within a print job.

In typical electrophotographic image forming devices, such as copy machines and laser beam printers, a photoconductive insulating member is charged to a uniform potential and thereafter exposed to a light image of an original document to be reproduced. The exposure discharges the photoconductive insulating surface in exposed or background areas and creates an electrostatic latent image on the member, which corresponds to the image areas contained within the document. Subsequently, the electrostatic latent image on the photoconductive insulating surface is made visible by developing the image with a marking material. Generally, the marking material comprises toner particles adhering triboelectrically to carrier granules, which is often referred to simply as toner. The developed image is subsequently transferred to the print medium, such as a sheet of paper. The fusing of the toner image onto paper is generally accomplished by applying heat to the toner with a heated roller and application of pressure. In multi-color printing, successive latent images corresponding to different colors are recorded on the photoconductive surface and developed with toner of a complementary color. The single color toner images are successively transferred to the copy paper to create a multi-layered toner image on the paper. The multi-layered toner image is permanently affixed to the copy paper in the fusing process.

To achieve optimum print quality and robustness of the marking engine, the marking engine and marking material are carefully matched. Thus, for a given marking engine, the marking material is formulated to meet the demands of the components of the marking engine and vice versa. For example, the marking material may have particular additives which enable the particular marking engine to maintain high print quality while enabling performance robustness.

Printing facilities now often have several different marking engines for printing documents. Each marking engine may have its own specific marking material which is incompatible with the other marking engines in the facility. Thus, if supplies of one marking material run out, another marking material cannot be substituted without severely compromising print quality or risking damage to the marking engine. Additionally, other consumables, such as photoreceptor belts, may also be specific to a particular type of marking engine.

Accordingly, supplies of each of these consumables are generally kept on hand to main full productivity of the marking engines.

CROSS REFERENCE TO RELATED PATENTS AND APPLICATIONS

The following applications, the disclosures of each being totally incorporated herein by reference are mentioned:

U.S. Provisional Application Ser. No. 60/631,651, filed Nov. 30, 2004, entitled "TIGHTLY INTEGRATED PARALLEL PRINTING ARCHITECTURE MAKING USE OF COMBINED COLOR AND MONOCHROME ENGINES," by David G. Anderson, et al.;

U.S. Provisional Patent Application Ser. No. 60/631,918, filed Nov. 30, 2004, entitled "PRINTING SYSTEM WITH MULTIPLE OPERATIONS FOR FINAL APPEARANCE AND PERMANENCE," by David G. Anderson et al.;

U.S. Provisional Patent Application Ser. No. 60/631,921, filed Nov. 30, 2004, entitled "PRINTING SYSTEM WITH MULTIPLE OPERATIONS FOR FINAL APPEARANCE AND PERMANENCE," by David G. Anderson et al.;

U.S. application Ser. No. 10/761,522, filed Jan. 21, 2004, entitled "HIGH RATE PRINT MERGING AND FINISHING SYSTEM FOR PARALLEL PRINTING," by Barry P. Mandel, et al.;

U.S. application Ser. No. 10/785,211, filed Feb. 24, 2004, entitled "UNIVERSAL FLEXIBLE PLURAL PRINTER TO PLURAL FINISHER SHEET INTEGRATION SYSTEM," by Robert M. Lofthus, et al.;

U.S. application Ser. No. 10/881,619, filed Jun. 30, 2004, entitled "FLEXIBLE PAPER PATH USING MULTIDIRECTIONAL PATH MODULES," by Daniel G. Bobrow.;

U.S. application Ser. No. 10/917,676, filed Aug. 13, 2004, entitled "MULTIPLE OBJECT SOURCES CONTROLLED AND/OR SELECTED BASED ON A COMMON SENSOR," by Robert M. Lofthus, et al.;

U.S. application Ser. No. 10/917,768, filed Aug. 13, 2004, entitled "PARALLEL PRINTING ARCHITECTURE CONSISTING OF CONTAINERIZED IMAGE MARKING ENGINES AND MEDIA FEEDER MODULES," by Robert M. Lofthus, et al.;

U.S. application Ser. No. 10/924,106, filed Aug. 23, 2004, entitled "PRINTING SYSTEM WITH HORIZONTAL HIGHWAY AND SINGLE PASS DUPLEX," by Lofthus, et al.;

U.S. application Ser. No. 10/924,113, filed Aug. 23, 2004, entitled "PRINTING SYSTEM WITH INVERTER DISPOSED FOR MEDIA VELOCITY BUFFERING AND REGISTRATION," by Joannes N. M. deJong, et al.;

U.S. application Ser. No. 10/924,458, filed Aug. 23, 2004, entitled "PRINT SEQUENCE SCHEDULING FOR RELIABILITY," by Robert M. Lofthus, et al.;

U.S. application Ser. No. 10/924,459, filed Aug. 23, 2004, entitled "PARALLEL PRINTING ARCHITECTURE USING IMAGE MARKING ENGINE MODULES (as amended)," by Barry P. Mandel, et al;

U.S. application Ser. No. 10/933,556, filed Sep. 3, 2004, entitled "SUBSTRATE INVERTER SYSTEMS AND METHODS," by Stan A. Spencer, et al.;

U.S. application Ser. No. 10/953,953, filed Sep. 29, 2004, entitled "CUSTOMIZED SET POINT CONTROL FOR OUTPUT STABILITY IN A TIPP ARCHITECTURE," by Charles A. Radulski et al.;

U.S. application Ser. No. 10/999,326, filed Nov. 30, 2004, entitled "SEMI-AUTOMATIC IMAGE QUALITY ADJUSTMENT FOR MULTIPLE MARKING ENGINE SYSTEMS," by Robert E. Grace, et al.;

U.S. application Ser. No. 10/999,450, filed Nov. 30, 2004, entitled "ADDRESSABLE FUSING FOR AN INTEGRATED PRINTING SYSTEM," by Robert M. Lofthus, et al.;

U.S. application Ser. No. 11/000,158, filed Nov. 30, 2004, entitled "GLOSSING SYSTEM FOR USE IN A TIPP ARCHITECTURE," by Bryan J. Roof;

U.S. application Ser. No. 11/000,168, filed Nov. 30, 2004, entitled "ADDRESSABLE FUSING AND HEATING METHODS AND APPARATUS," by David K. Biegelsen, et al.;

U.S. application Ser. No. 11/000,258, filed Nov. 30, 2004, entitled "GLOSSING SYSTEM FOR USE IN A TIPP ARCHITECTURE," by Bryan J. Roof;

U.S. application Ser. No. 11/001,890, filed Dec. 2, 2004, entitled "HIGH RATE PRINT MERGING AND FINISHING SYSTEM FOR PARALLEL PRINTING," by Robert M. Lofthus, et al.;

U.S. application Ser. No. 11/002,528, filed Dec. 2, 2004, entitled "HIGH RATE PRINT MERGING AND FINISHING SYSTEM FOR PARALLEL PRINTING," by Robert M. Lofthus, et al.;

U.S. application Ser. No. 11/051,817, filed Feb. 4, 2005, entitled "PRINTING SYSTEMS," by Steven R. Moore, et al.;

U.S. application Ser. No. 11/069,020, filed Feb. 28, 2004, entitled "PRINTING SYSTEMS," by Robert M. Lofthus, et al.;

U.S. application Ser. No. 11/070,681, filed Mar. 2, 2005, entitled "GRAY BALANCE FOR A PRINTING SYSTEM OF MULTIPLE MARKING ENGINES," by R. Enrique Viturro, et al.;

U.S. application Ser. No. 11/081,473, filed Mar. 16, 2005, entitled "PRINTING SYSTEM," by Steven R. Moore;

U.S. application Ser. No. 11/084,280, filed Mar. 18, 2005, entitled "SYSTEMS AND METHODS FOR MEASURING UNIFORMITY IN IMAGES," by Howard Mizes;

U.S. application Ser. No. 11/089,854, filed Mar. 25, 2005, entitled "SHEET REGISTRATION WITHIN A MEDIA INVERTER," by Robert A. Clark et al.;

U.S. application Ser. No. 11/090,498, filed Mar. 25, 2005, entitled "INVERTER WITH RETURN/BYPASS PAPER PATH," by Robert A. Clark;

U.S. application Ser. No. 11/090,502, filed Mar. 25, 2005, entitled IMAGE QUALITY CONTROL METHOD AND APPARATUS FOR MULTIPLE MARKING ENGINE SYSTEMS," by Michael C. Mongeon;

U.S. application Ser. No. 11/093,229, filed Mar. 29, 2005, entitled "PRINTING SYSTEM," by Paul C. Julien;

U.S. application Ser. No. 11/095,872, filed Mar. 31, 2005, entitled "PRINTING SYSTEM," by Paul C. Julien;

U.S. application Ser. No. 11/094,864, filed Mar. 31, 2005, entitled "PRINTING SYSTEM," by Jeremy C. dejong, et al.;

U.S. application Ser. No. 11/095,378, filed Mar. 31, 2005, entitled "IMAGE ON PAPER REGISTRATION ALIGNMENT," by Steven R. Moore, et al.;

U.S. application Ser. No. 11/094,998, filed Mar. 31, 2005, entitled "PARALLEL PRINTING ARCHITECTURE WITH PARALLEL HORIZONTAL PRINTING MODULES," by Steven R. Moore, et al.;

U.S. application Ser. No. 11/102,899, filed Apr. 8, 2005, entitled "SYNCHRONIZATION IN A DISTRIBUTED SYSTEM," by Lara S. Crawford, et al.;

U.S. application Ser. No. 11/102,910, filed Apr. 8, 2005, entitled "COORDINATION IN A DISTRIBUTED SYSTEM," by Lara S. Crawford, et al.;

U.S. application Ser. No. 11/102,355, filed Apr. 8, 2005, entitled "COMMUNICATION IN A DISTRIBUTED SYSTEM," by Markus P. J. Fromherz, et al.;

U.S. application Ser. No. 11/102,332, filed Apr. 8, 2005, entitled "ON-THE-FLY STATE SYNCHRONIZATION IN A DISTRIBUTED SYSTEM," by Haitham A. Hindi;

U.S. application Ser. No. 11/109,558, filed Apr. 19, 2005, entitled "SYSTEMS AND METHODS FOR REDUCING IMAGE REGISTRATION ERRORS," by Michael R. Furst et al.;

U.S. application Ser. No. 11/109,566, filed Apr. 19, 2005, entitled "MEDIA TRANSPORT SYSTEM," by Mandel et al.;

U.S. application Ser. No. 11/109,996, filed Apr. 20, 2005, entitled "PRINTING SYSTEMS," by Michael C. Mongeon et al.;

U.S. application Ser. No. 11/115,766, filed Apr. 27, 2005, entitled "IMAGE QUALITY ADJUSTMENT METHOD AND SYSTEM," by Robert E. Grace;

U.S. application Ser. No. 11/122,420, filed May 5, 2005, entitled "PRINTING SYSTEM AND SCHEDULING METHOD," by Austin L. Richards;

U.S. application Ser. No. 11/136,821, filed May 25, 2005, entitled "AUTOMATED PROMOTION OF MONOCHROME JOBS FOR HLC PRODUCTION PRINTERS," by David C. Robinson;

U.S. application Ser. No. 11/136,959, filed May 25, 2005, entitled "PRINTING SYSTEMS," by Kristine A. German et al.;

U.S. application Ser. No. 11/137,634, filed May 25, 2005, entitled "PRINTING SYSTEM," by Robert M. Lofthus et al.;

U.S. application Ser. No. 11/137,251, filed May 25, 2005, entitled "SCHEDULING SYSTEM," by Robert M. Lofthus et al.;

U.S. C-I-P application Ser. No. 11/137,273, filed May 25, 2005, entitled "PRINTING SYSTEM," by David G. Anderson et al.;

U.S. application Ser. No. 11/143,818, filed Jun. 2, 2005, entitled "INTER-SEPARATION DECORRELATOR," by Edul N. Dalal et al.;

U.S. application Ser. No. 11/146,665, filed Jun. 7, 2005, entitled "LOW COST ADJUSTMENT METHOD FOR PRINTING SYSTEMS," by Michael C. Mongeon;

U.S. application Ser. No. 11/152,275, filed Jun. 14, 2005, entitled "WARM-UP OF MULTIPLE INTEGRATED MARKING ENGINES," by Bryan J. Roof et al.;

U.S. application Ser. No. 11/11/156,778, filed Jun. 20, 2005, entitled "PRINTING PLATFORM," by Joseph A. Swift;

U.S. application Ser. No. 11/157,598, filed Jun. 21, 2005, entitled "METHOD OF ORDERING JOB QUEUE OF MARKING SYSTEMS," by Neil A. Frankel;

U.S. application Ser. No. 11/166,460, filed Jun. 24, 2005, entitled "GLOSSING SUBSYSTEM FOR A PRINTING DEVICE," by Bryan J. Roof et al.;

U.S. application Ser. No. 11/166,763, filed Jun. 24, 2005, entitled "XEROGRAPHIC DEVICE STREAK FAILURE RECOVERY," by Bruce Thayer;

U.S. application Ser. No. 11/166,581, filed Jun. 24, 2005, entitled "MIXED OUTPUT PRINT CONTROL METHOD AND SYSTEM," by Joseph H. Lang et al.;

U.S. application Ser. No. 11/166,961, filed Jun. 24, 2005, entitled "PRINTING SYSTEM SHEET FEEDER," by Steven R. Moore;

U.S. application Ser. No. 11/166,299, filed Jun. 24, 2005, entitled "PRINTING SYSTEM," by Steven R. Moore;

U.S. application Ser. No. 11/168,152, filed Jun. 28, 2005, entitled "ADDRESSABLE IRRADIATION OF IMAGES," by Kristine A. German et al.;

U.S. application Ser. No. 11/170,975, filed Jun. 30, 2005, entitled "METHOD AND SYSTEM FOR PROCESSING SCANNED PATCHES FOR USE IN IMAGING DEVICE CALIBRATION," by R. Victor Klassen;

U.S. application Ser. No. 11/170,873, filed Jun. 30, 2005, entitled "COLOR CHARACTERIZATION OR CALIBRATION TARGETS WITH NOISE-DEPENDENT PATCH SIZE OR NUMBER," by R. Victor Klassen;

U.S. application Ser. No. 11/170,845, filed Jun. 30, 2005, entitled "HIGH AVAILABILITY PRINTING SYSTEMS," by Meera Sampath et al.; and U.S. application Ser. No. 11/189,371, filed Jul. 26, 2005, entitled "PRINTING SYSTEM," by Steven R. Moore et al.

Incorporation By Reference

The following references, the disclosures of which are incorporated by reference in their entireties, relate to what have been variously called "tandem engine" printers, "parallel" printers, or "cluster printing" (in which an electronic print job may be split up for distributed higher productivity printing by different printers, such as separate printing of the color and monochrome pages: U.S. application Ser. No. 10/924,106, filed Aug. 23, 2004, entitled "PRINTING SYSTEM WITH HORIZONTAL HIGHWAY AND SINGLE PASS DUPLEX," by Lofthus, et al., U.S. application Ser. No. 10/924,459, filed Aug. 23, 2004, entitled "PARALLEL PRINTING ARCHITECTURE USING IMAGE MARKING ENGINE MODULES," by Mandel, et al., U.S. Pat. No. 5,568,246 to Keller, et al., U.S. Pat. No. 4,587,532 to Asano, U.S. Pat. No. 5,570,172 to Acquaviva, U.S. Pat. No. 5,596,416 to Barry, et al.; U.S. Pat. No. 5,995,721 to Rourke et al; U.S. Pat. No. 4,579,446 to Fujino; U.S. Pat. No. 5,489,969 to Soler, et al.; a 1991 "Xerox Disclosure Journal" publication of November-December 1991, Vol. 16, No. 6, pp. 381-383 by Paul F. Morgan; and a Xerox Aug. 3, 2001 "TAX" publication product announcement entitled "Cluster Printing Solution Announced."

U.S. Pat. No. 6,895,191 to Rommelmann, et al. discloses verification of the correctness of a particular replacement module of a printing apparatus before the apparatus fully engages the replacement module. A printing apparatus coupler establishes a communication link with a tag on the replacement module as the replacement module is being inserted into the printing apparatus. The printing apparatus coupler receives module identifying information from the tag. The coupler determines, from the identifying information, whether the replacement module is appropriate for that location in that printing apparatus, and performs either an acceptance action to accept the replacement module, or a rejection action to reject the module. The Rommelmann, et al. patent is incorporated herein by reference in its entirety.

BRIEF DESCRIPTION

Aspects of the exemplary embodiment relate to a marking engine and to a method of marking.

In one aspect, a marking engine includes a developer unit which houses a marking material, the developer unit selectively receiving a replacement cartridge containing marking material. A marking material identification system obtains information on the marking material. A first processing component receives information from the identification system and determines, for at least one component of the marking engine, at least one appropriate adjustment for rendering the marking engine compatible with the marking material based on information on the marking material received from the identification system.

In another aspect, a marking engine includes a plurality of components which each perform a portion of a marking operation. A processing component receives information on a replacement module which is to be incorporated into the marking engine. The processing component determines, for one or more of the components of the marking engine, appropriate adjustments for rendering the marking engine compatible with the replacement module, based on the received information.

In another aspect, a method includes establishing a set point for a component of a marking engine for each of a plurality of replacement modules, the component set point for each replacement module being selected to render the marking engine compatible with the respective replacement module. A replaceable module of the marking engine is replaced with a selected one of the plurality of replacement modules. The set point for the selected one of the plurality of replacement modules is applied.

DETAILED DESCRIPTION

Figure 1:
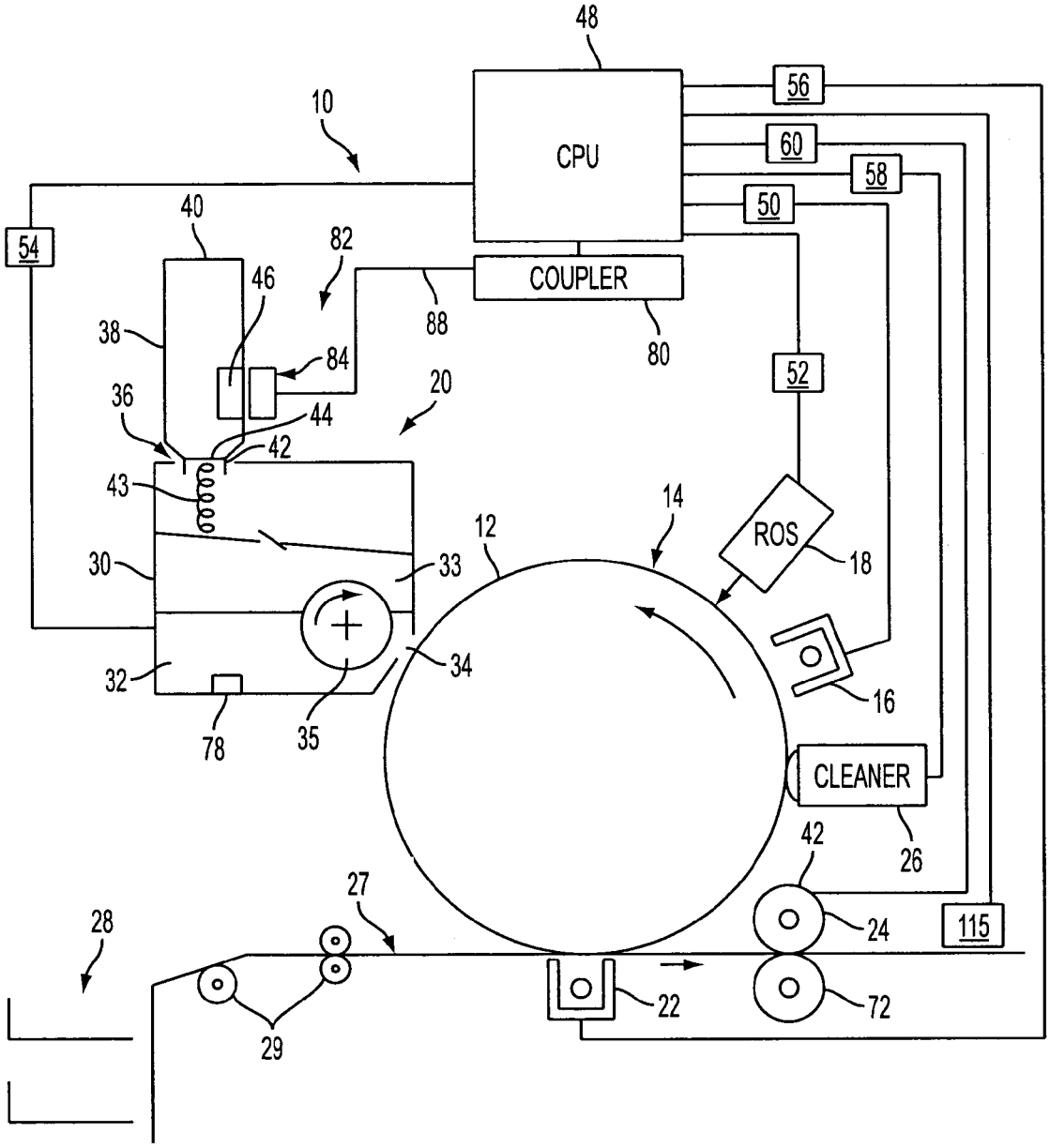
FIG. 1 is a schematic view of a marking engine according to one aspect of the exemplary embodiment.

Aspects of the exemplary embodiment relate to a marking engine and to a printing system which comprises one or more marking engines. The marking engine includes a developer unit which receives a marking material, such as toner particles with an associated carrier material for applying to a print media, such as paper, in the course of formation of an image. A refill opening in the developer housing may be selectively connectable with a consumable replacement cartridge containing marking material. A marking material identification system identifies the marking material. The marking material identification system may include a reader which obtains information from a compatible identifier, such as a tag, which is associated with the cartridge. Alternatively or additionally, the identification system may include a user input, or other suitable marking material identification system. A processing component communicates with the identification system and determines, for one or more components of the marking engine, appropriate modifications for rendering the marking engine compatible with the marking material based on information from the identification system.

In another aspect, a marking engine includes a processing component which receives information on a replacement module which is to be incorporated into the marking engine. The replacement module may include a consumable replacement cartridge containing a consumable, such as a marking material, or be another replacement module, such as a photoreceptor belt. The processing component determines, for one or more components of the marking engine, appropriate modifications for rendering the marking engine compatible with the replacement module/consumable based on the received information.

The term "marking engine" is used herein generally to referto a device for applying an image to print media. Print media generally refers to a usually flimsy physical sheet of paper, plastic, or other suitable physical print media substrate for images, whether precut or web fed. A "printing system" can be a digital copier or printer, bookmaking machine, facsimile machine, multi-function machine, or the like and can include one or more marking engines, as well as other processing components, such as paper feeders, finishers, and the like.

In one aspect, replacement modules are selected from a set comprising at least two non-identical replacement modules, the replacement modules being interchangeable with each of the other replacement modules in the set. The marking engine is compatible or can be rendered compatible with all of the replacement modules in the set, through appropriate modification. An installed replacement module can be substituted with any of the replacement modules in the set and the appropriate modifications, if any, made automatically by the marking engine to render the marking engine compatible.

In another aspect, a printing system comprises multiple marking engines, two or more of the marking engines being compatible or capable of being rendered compatible with the same replacement module, through appropriate modification of one or more of the marking engines.

Figure 2:
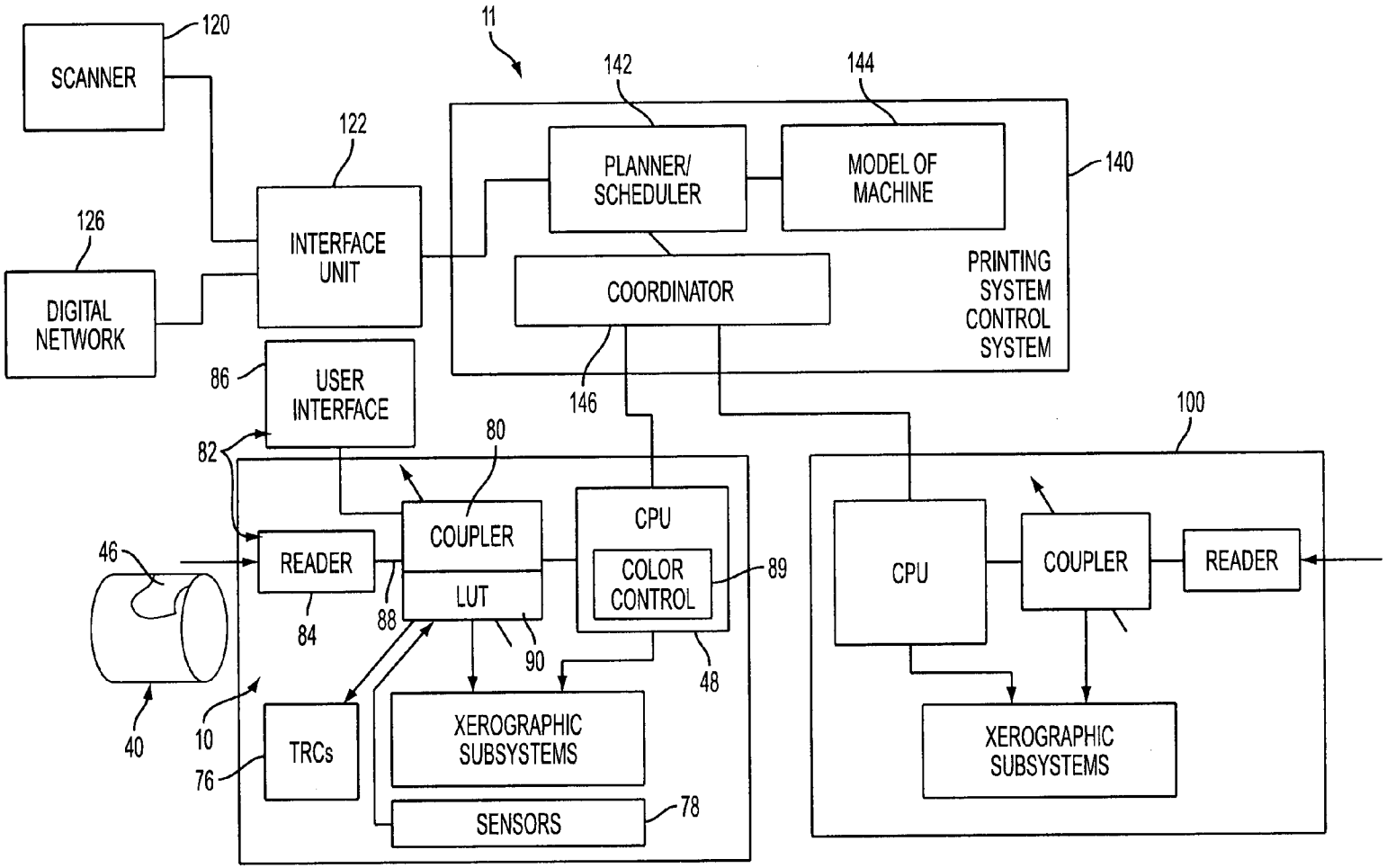
FIG. 2 is a block diagram of a printing system incorporating the marking engine of FIG. 1.
Figure 3:
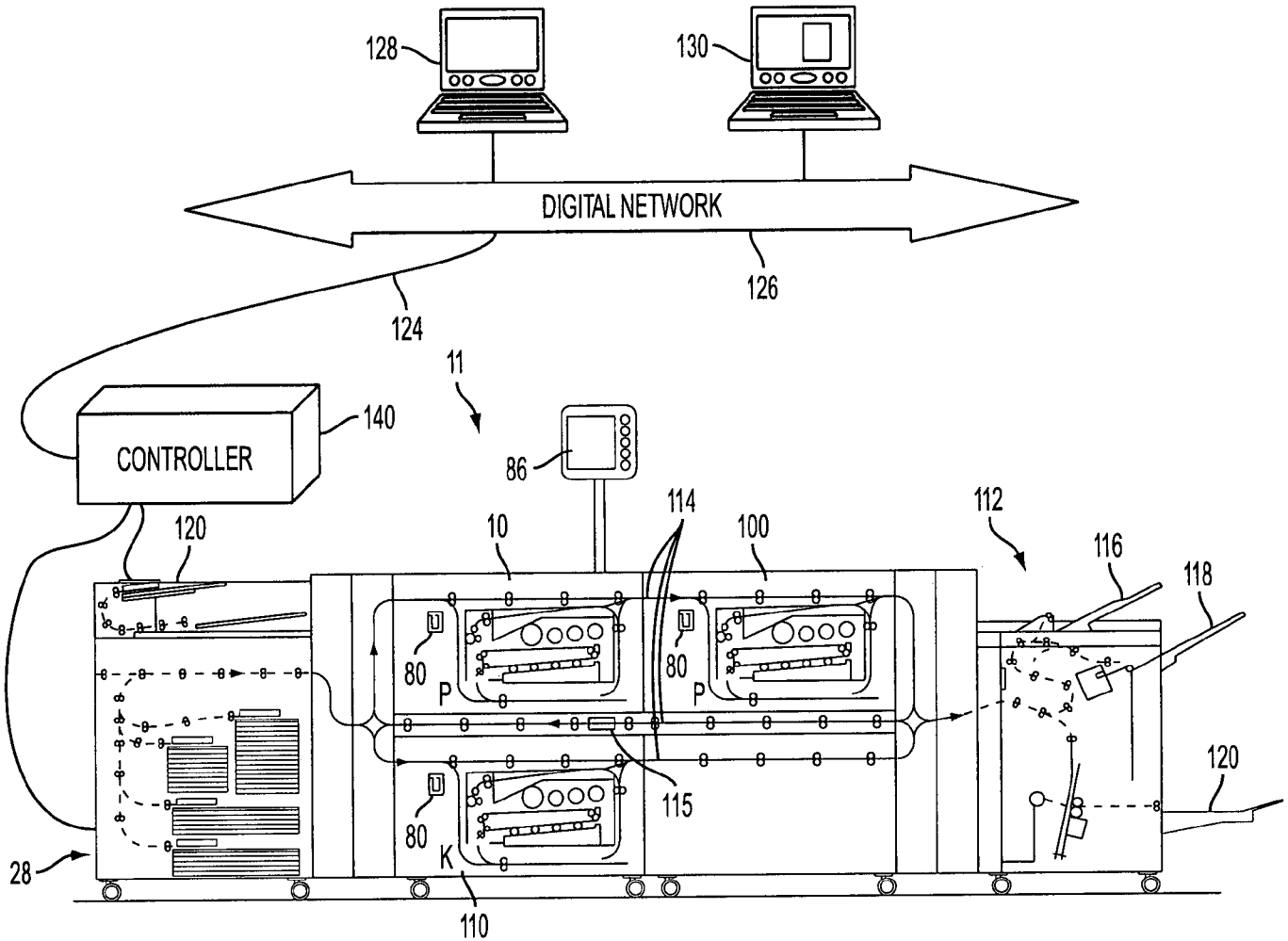
FIG. 3 is a side view of the printing system of FIG. 2.

With reference to FIG. 1, a marking engine 10 serves as a replaceable xerographic module in a xerographic printing system 11, such as that illustrated in FIGS. 2 and 3. FIG. 2 illustrates a printing system with two marking engines, while FIG. 3 shows three marking engines. The marking engine 10 includes many of the hardware elements employed in the creation of desired images by electrophotographical processes. In the case of a xerographic device, the marking engine typically includes a charge retentive surface, such as a rotating photoreceptor 12 in the form of a belt or drum. The images are created on a surface 14 of the photoreceptor. Disposed at various points around the circumference of the photoreceptor 12 are xerographic components. The xerographic components each perform a portion of a marking operation (the formation of an image on print media). These components may include a charging station 16 for each of the colors to be applied (one in the case of a monochrome printer, four in the case of a CMYK printer), such as a charging corotron, an exposure station 18, such as a raster output scanner (ROS), which forms a latent image on the photoreceptor, a developer unit 20, associated with each charging station for developing the latent image formed on the surface of the photoreceptor, a transferring unit 22, such as a transfer corotron, a fuser 24, and a cleaning device 26. A printing system 11 capable of printing in multiple colors may have multiple developer units, each developing the photoreceptor with a different primary-color toner. Paper or other print media is supplied to the marking engine along a paper path 27 from media supply trays 28. The paper is drawn from the supply trays 28, typically one sheet at a time, by feed rollers 29.

In operation, the photoreceptor 12 rotates and is charged at the charging station 16. The charged surface arrives at the exposure station 18, where a latent image is formed. The portion of the photoreceptor on which the latent image is formed arrives at the developer unit 20, which applies a marking material, comprising toner particles and associated carrier particles, to the latent image to obtain a toner image. The developed image moves with the photoreceptor to the transferring unit 22, which transfers the toner image thus formed to the surface of a print media substrate, such as a sheet of paper, by applying a potential to the sheet. The sheet and image are conveyed away from the photoreceptor to the fuser 24, which fuses the image to the sheet. The fuser 24 generally applies at least one of heat and pressure to the sheet to physically attach the toner and to provide a level of gloss to the printed media. Meanwhile, the photoreceptor 12 rotates to the cleaning device 26, which removes residual toner and charge from the photoreceptor, ready for beginning the process again. It is to be appreciated that the marking engine can include an input/output interface, a memory, a marking cartridge platform, a marking driver, a function switch, a controller and a self-diagnostic unit, all of which can be interconnected by a data/control bus.

Certain modules in the printing system 11 are typically designed to be replaceable during the lifetime of the printing system. For example, during use, the printing system 11 consumes the marking material contained in the developer unit(s). A container for the marking material is generally designed to be replaceable by the user of the printing system 11. Other modules may also be replaceable, either by a user or by a skilled technician. Examples of printing system modules that may be designed to be replaceable include the photoreceptor belt or drum 12, the cleaning device 26, the transfer corotron 22, and the fusing subsystem 24 (or individual components of the fusing subsystem). While particular reference is made to marking material cartridges as replacement modules, it is to be appreciated that other replacement modules, such as photoreceptor belts, are also contemplated. In addition to the applicability to different replacement modules of an electrophotographic printing system, the principles are also applicable to replacement modules of other types of printing system. For example, in an ink jet printer, the replacement module may be a container holding ink, either solid ink for a phase change ink jet printing apparatus or liquid ink for a liquid ink printing apparatus. Replacement modules for an ink jet printer may also include the printhead, a transfer drum, and maintenance elements for the printhead and/or drum.

Each developer unit 20 includes a developer housing 30 which stores a supply of a marking material 32. The housing includes a sump 33 with an outlet 34 through which the marking material is released onto the photoreceptor surface 14. Specifically, marking material is dispensed into the sump 33 where it is mixed using various augers (not shown) and is circulated so that it is brought into contact with a rotating developer roll 35. The development roll then brings the marking material into the vicinity of the photoreceptor drum 12, where electrostatic forces drive the toner from the developer roll 35 on to the appropriate image area on the photoreceptor. These electrostatic forces are driven, in part, by a bias voltage applied to the developer roll 35.

A refill opening 36, at an upper end of the developer housing 30, is configured for selectively receiving a replacement module in the form of a consumable replacement cartridge 38. Generally, the cartridge 38 includes a container 40 filled with marking material 32. The container has an outlet 42 which may be configured for threadable or other releasable interconnection with the developer housing at or adjacent to the refill opening 36. The developer unit 20 and/or container 40 may also include a suitable release mechanism, such as an auger 43, for releasing the marking material 32 once the interconnection has been made. A seal 44 covers the container outlet 42 to hold the toner inside the toner container until the container fully engages the developer unit 20. The seal 44 is fracturable so that the end of the auger 43 can pierce the seal and enter the interior of the toner container.

The illustrated cartridge 38 includes an identifier 46, which allows the marking material contained in the container to be identified and/or categorized, as described in greater detail below. The identifier may be attached to, printed on, or otherwise associated with the container. While the illustrated identifier 46 is mounted to an exterior wall of the container, other locations are also contemplated. The identifier 46 may be in the form of a tag, such as a customer replaceable unit monitor (CRUM), a radiofrequency tag, or a UPC code, or may include a color code, detectable chemical marker, a combination thereof, or the like. In the case of a CRUM as an identifier, the CRUM or CRUMs may contain memory that stores information pertaining to the replacement module, as described more fully in U.S. Pat. No. 6,016,409 to Beard, et al., which is incorporated herein in its entirety by reference. An exemplary CRUM is described in U.S. Pat. No. 6,532,351, to Richards, et al., incorporated herein by reference in its entirety. Each CRUM may be capable of communicating with the coupler 80 at certain times during use of the printing system 11 so that the coupler can read information from, and in some cases, write information to, the CRUM for the replacement module, as described in greater detail in U.S. Pat. No. 6,895,191 to Rommelmann, et al., incorporated herein by reference in its entirety.

In general, there may be several cartridges 38 provided, each with a different marking material and an associated identifier 46 corresponding to the marking material in the cartridge. For example, a set of marking materials, all of which can be utilized by the marking engine 10, may include one or more of a "normal" marking material, suitable for most print jobs an enhanced print quality marking material, formulated for high quality print jobs, which may be more expensive to manufacture than the normal marking material, a marking material with lower additives than the normal marking material, which enables a print job to be printed at a lower run cost, while potentially sacrificing some of the quality, and a custom color marking material, formulated to produce customer specific colors, such as pantones. Other marking materials are also contemplated, such as those suited to high speed printing operations and printing operations involving overprinting and hence multiple fusing operations.

The information included in the identifier 46 may enable a relatively coarse categorization, such as between a high quality marking material, a normal marking material, a reduced cost/lower quality material, and a custom color marking material. In other aspects, more detailed information may be included in the identifier 46, such as the type of resin, toner pigment loading, and/or additive types and additive loadings.

A marking engine control system 48, such as a CPU, includes a processing component which controls each of the xerographic components 16, 18, 20, 22, 24, 26. One or more of the components is adjustable by means of a suitable actuator 50, 52, 54, 56, 58, 60, respectively. For example, each subcomponent 16, 18, 20, 22, 24, 26 may have a plurality of set points, e.g., two, three, four or more set points, or set points comprising a range of adjustment, by which the subcomponent can be modified to render the marking engine compatible with a particular marking material selected from a set of different marking materials.

In the case of the fuser 24, for example, the set points may include one or more of: a plurality of different temperature set points for a heated fuser roll 70; a plurality of different pressure settings for the pressure applied between the fuser roll 70 and a pressure roll 72; and a plurality of dwell time set points. Additionally, the algorithm used for closed-loop control of the fuser may require different gains to maintain adequate fusing performance. In the case of the charging station 16, the set points may enable the charge level to be adjusted. In the case of the exposure station 18, the set points may enable adjustment of the exposure level. For the developer unit 20, the set points may enable adjustment of the bias potential on the development rolls. The set points for the transfer station 22 may enable transfer currents to be adjusted. In the case of the cleaning device 26, the force applied to the cleaning blade in a blade-type cleaning device could be adjusted and/or the bias voltage could be adjusted in an electrostatic brush cleaning device. The tone reproduction curve (TRC) for the marking engine may also be modified by the CPU 48. For example, the CPU may store a plurality of tone reproduction curves 76, one for each of a plurality of marking materials.

In the case of a photoreceptor 12 as a replacement module, the modifications to the marking engine may include changes to the pressure applied by a blade of the cleaning system. Different photoreceptor belts create different friction forces, which can affect the load on the motor. By adjustment to the normal force on the blade, the friction can be maintained within an acceptable range to avoid damage to the motor.

In one embodiment, one or more of the marking engine components 16, 18, 20, 22, 24, 26 may include a sensor for providing feedback on the component to the CPU. For example, the developer unit 20 may include a toner concentration sensor 78, such as a packer toner concentration sensor, for sensing toner concentration (TC). A mass sensor such as an enhanced toner area coverage (ETAC) sensor (not shown), may measure developed mass per unit area. Electrostatic voltages are measured using a sensor such as an ElectroStatic Voltmeter (ESV). A full width array (FWA) sensor may be used to measure the color and/or pattern of developed mass on the photoreceptor. Another FWA sensor may measure the color and/or pattern of transferred mass on an intermediate transfer belt. Another FWA sensor, either in line or offline, may be used to measure the color and other image quality characteristics on the printed page. A spectrophotometer, either in line or offline, may be used to measure the color of the page.

With reference also to FIG. 2, a processing component or coupler 80, which may be a part of the CPU 48 or physically separate therefrom, determines suitable modifications to the marking engine components 16, 18, 20, 22, 24, 26, based on information on the installed marking material or other replacement module provided by the identifier 46 or otherwise. The coupler 80 communicates the modifications to the CPU 48, which then adjusts the appropriate subcomponent or components 16, 18, 20, 22, 24, 26 using the actuators 50, 52, 54, 56, 58, 60 to change the set points. It will be appreciated that the adjustments made to the marking engine 10 to accommodate a different replacement module may include adjustments to the subcomponent in which the replacement module is installed or to which it is most closely related to (e.g., the developer unit 20 in the case of a change in the marking material 32). However, the adjustments made to the marking engine 10 may alternatively or additionally include adjustments to one or more other components of the marking engine (such as the charging station(s) 16, exposure station(s) 18, transferring unit 22, fuser 24, and cleaning device 26, in the case of a change in the marking material 32).

A marking material identification system 82 provides information on the marking material 32 to the coupler 80. The identification system 82 illustrated in FIG. 1 includes a reader 84 which is capable of obtaining information associated with the toner cartridge 38, e.g., from the identifier 46, from which the marking material can be identified and/or categorized. The reader 84 may comprise one or more of a CRUM reader, bar code reader, radiofrequency source and/or detector, colorimetric sensor, ultraviolet or infrared sensor, chemical sensor, other reader which is compatible with the identifier 46. In one embodiment, the reader 84 establishes a communication link with the identifier 46 on the replacement module 38, for example, as the replacement module is being inserted into the developer unit 20. The reader 84 communicates the information on the marking material to the coupler 80 in a suitable form by a link 88, such as a wired or wireless link.

The coupler 80 uses the information from the reader 84 to determine appropriate adjustments within the marking engine which directly or indirectly result in changes being made to the set points of the marking engine components 16, 18, 20, 22, 24, 26. In one embodiment, the coupler 80 may determine the new set points for the marking engines and forward these to the CPU 48. In another embodiment, the coupler 80 selects an appropriate algorithm (e.g., processing software or processing component) to be used by the control system 48 or the marking engine component 16, 18, 20, 22, 24, 26 in determining appropriate adjustments to the set points, and/or other changes to the marking engine component set up. Algorithms for marking engines are well known, as described, for example, in U.S. Pat. No. 5,471,313 to Thieret, et al., the disclosure of which is incorporated herein by reference in its entirety. For example, there may be one control algorithm for a particular marking engine component 16, 18, 20, 22, 24, 26, which is used when a first replacement module is installed, and another algorithm which is used when a different type of replacement module is installed. For example, a proportional integral (PI) control algorithm with one set of gains may be appropriate for one type of replacement module, while a state feedback controller, with associated gains may be more appropriate for another replacement module. The coupler 80 may store both algorithms and select the appropriate one to be used by the marking engine component to accommodate for the replacement module currently installed or may provide instructions to the CPU or marking engine component as to which algorithm to use. In some cases, the same algorithm may be used for two different replacement modules but with different gains. The coupler may store the different gains and either incorporate the appropriate gains into the algorithm or may send the gains to the CPU or marking engine component for incorporating into the algorithm.

The set points which the coupler 80 adjusts (either directly, or indirectly, e.g., through changes to an algorithm which adjusts the set point), may include one or more of a set point for the heated fuser roll 42 of the marking engine, a set point for a pressure applied between fuser rolls 42, 72 of the marking engine, a set point for dwell time within the fuser 24 of the marking engine, a controller gain set point for the charging station controller 50 of the marking engine, a controller gain set point for the development unit controller 54 of the marking engine, a controller gain set point for a transfer station controller 56 of the marking engine, a controller gain set point for the fuser controller 60 of the marking engine, a controller gain set point for the cleaning device controller 58 of the marking engine, a charge level set point for the charging station 16 of the marking engine, an exposure level set point of an exposure station 18 of the marking engine, a bias potential of a developer unit of the marking engine, a transfer current set point of the transfer station 22 of the marking engine, at least one of a cleaning blade force and a bias voltage for the cleaning device 26 of the marking engine, a toner concentration level for the developer unit 20 of the marking engine, a controller gain set point for a tone reproduction curve controller 76 of the marking engine, and a controller gain set point for a color controller 89 of the marking engine.

In addition to providing different set points for the marking engine components to accommodate different replacement modules, the coupler 80 may also enable appropriate changes to marking engine component's operational modes. For example, one replacement module may be best utilized when a particular procedure for cycling up (the procedure by which a marking engine component is brought from a resting state to a fully operational state) is used, which is different from the cycling up procedure for another replacement module. The controller may thus adjust one or more of an operational mode for cycling-up the marking engine, an operational mode for running the marking engine, and an operational mode for cycling-down the marking engine.

In another aspect, the coupler 80 may interact with the sensors 78 associated with the marking engine. The various sensors in a marking engine are typically calibrated for specific types of materials and replacement modules used in the marking engine. The calibration parameters for one type of material, e.g., toner, may be unsuited for another type. As an example, the calibration processor for an ETAC developed mass sensor provides mass levels for corresponding optical measurements in the form of voltages. The relationship between mass and voltage may be different, depending on the type of toner used. Accordingly, the coupler may instruct the sensor as to which calibration parameters should be used for the installed toner. Additionally, different sensing procedures may be appropriate for different replaceable modules.

The coupler 80 may also determine, from the identifying information, whether the replacement module is appropriate for the particular marking engine and may perform either an acceptance action to accept the replacement module, or a rejection action to reject the module. U.S. Pat. No. 6,895,191 to Rommelmann, et al., incorporated herein in its entirety by reference, discloses a sensor and coupler for verification of the correctness of a particular replacement module of a printing system 11 before the module fully engages the replacement module which can be incorporated herein.

Alternatively or additionally, the identification system 82 may include a user interface 86 (FIG. 2), such as a keyboard, touch screen, or the like, through which a user can input information on the marking material 32 or other replacement module.

Once the cartridge 38 has been installed, the coupler 80 uses the information from the identification system 82 to reconfigure the marking engine 10 so that it is compatible with the marking material, to the extent possible with the range of available set points and/or other adjustments possible. For example, the coupler determines appropriate settings for the marking engine components 16, 18, 20, 22, 24, 26 or selects appropriate algorithms/gains to be used for determining settings for the marking engine components and may select an appropriate tone reproduction curve (TRC) from the set of TRCs 76.

In one embodiment, the coupler 80 includes a memory 90, such as a look up table (LUT), which stores information on the marking engine set points (or appropriate algorithms and/or gains to use) for each of a set of compatible marking materials 32 and/or other replacement modules. The compatible marking materials are generally those which have been determined to provide at least a minimum acceptable print quality when used with the marking engine 10. Each marking material 32 may be associated with its own group of adjustments (e.g., set points/algorithms/gains). For example, an enhanced print quality development material may have one group of toner concentration, development bias and/or charging level, transfer current, fuser temperature, fuser pressure, and fuser dwell time set points while a development material with reduced additive loading may have a different toner concentration target, a different development bias and/or charging level, a different transfer current, and/or different fuser set points.

Each of the marking engine component set points can be established experimentally, by an iterative process. For example, for a particular marking material, the set points are adjusted and test sheets printed until an optimal set of set points for the marking engine components are found for achieving print quality and/or marking engine robustness. These set points are then entered in the look up table 90 as the established set points for the particular marking material. Tests may be run in this way for several different marking materials. Periodically, additional test sheets may be printed and minor modifications made to the set points/algorithms/gains for a particular marking material in use. Thus, the coupler 80 can be an adaptive system which learns from prior experience with the same type of replacement module. Alternatively, the set points may be established theoretically, in whole or in part, based on known characteristics of the marking material.

The memory 90 may also store information on other marking materials which are considered incompatible with the marking engine 10. For example, incompatible marking materials may include liquid marking materials, where the marking engine uses particulate marking materials, two component marking materials, where the marking engine uses a single component developer system, a waxless marking material for a marking engine with an oilless fuser, and marking materials which are not considered to provide acceptable print quality, even when modifications to the set points are made. Marking materials in cartridges which have no readable identifier or for which no information is input via the user interface 82 may also be classed as incompatible marking materials. The coupler 80 may alert the user when an incompatible marking material is detected, for example, via the user interface 82. Additionally, the memory 90 may store information on a plurality of marking material acceptability categories, such as two, three, four or more categories. For example, one category may include marking materials which provide below normal print quality, another category may include marking materials which provide normal print quality, and so forth. Each of the acceptable marking materials is associated with one of the categories, and generally, with only one of the acceptability categories. The coupler 80 may alert the user when a marking material in a below normal print quality category is selected for the marking engine and suggest a marking material expected to provide a higher print quality. It is to be appreciated that where a printing system 11 includes multiple marking engines, such as those of FIGS. 2 and 3, a marking material may fall into one acceptability category for one marking engine and another category for another marking engine.

With reference once more to FIG. 1, the reader 84 may be positioned, relative to the developer housing opening 36, such that when the cartridge 38 is brought into proximity with the reader 84, the reader can read the identifier 46. For example, the reader may be positioned to read the identifier when the cartridge 38 is positioned with its opening 42 in or adjacent the opening 36. In one embodiment, the reader is positioned to read the identifier prior to releasing the marking material into the housing 30. In this way, if a cartridge which is incompatible with the marking engine is presented, the lack of compatibility can be determined and the user alerted, e.g., via the user interface 86.

While particular reference is made to electrophotographic printers, suitable marking engines 10 may also include ink-jet printers, including solid ink printers, thermal head printers that are used in conjunction with heat sensitive paper, and other devices capable of marking an image on a substrate.

With reference once more to FIG. 2, and reference also to FIG. 3, a printing system 11 incorporating the marking engine 10 may include a plurality of marking engines 10, 100, 110, which may be similarly configured to marking engine 10 in that each has its own CPU, coupler, and at least one reader for a corresponding identifier on a replacement module, analogous to CPU 48, coupler 80, and reader 84. A common print media source 28 supplies paper to each of the marking engines, although it is also contemplated that each marking engine may have its own print media source. The print media source 28, marking engines 10, 100, 110, and an output destination 112, such as a finisher, are all interconnected by a print media conveyor 114 comprising a network of paper pathways. A sensor station 115 is located in one pathway of the conveyor system and may include one or more sensors, such as a spectrophotometer for measuring the color of the printed images. The sensor station is accessible to all (or at least some on the marking engines 10, 100, 110 in the printing system and may provide feedback to the coupler 80 of one or more of the marking engines based on sensed parameters. The coupler may use the information to update the set points/algorithms/gains in the LUT 90 currently used for the marking engine and to be used again in the future when the same type of replacement module is installed. A sensor module suitable for use as the sensor station 115 herein is described, for example, in U.S. patent application Ser. No. 11/081,473, filed Mar. 16, 2005, entitled PRINTING SYSTEM, by Steven R. Moore and U.S. application Ser. No. 10/917,676, filed Aug. 13, 2004, entitled "MULTIPLE OBJECT SOURCES CONTROLLED AND/OR SELECTED BASED ON A COMMON SENSOR," by Robert M. Lofthus, et al. The sensor station 115 may be located in a pathway where the paper can be slowed down to an appropriate speed for sensing.

The sensor station 115 communicates with the color controller 89. One suitable color controller is described in U.S. Pat. No. 6,714,319, which is incorporated herein in its entirety. The color controller 89 helps to ensure that the colors produced by the marking engines are consistently reproduced from page-to-page and machine-to-machine, despite variations in media properties, materials, environment and other disturbances. Color can be described in a 3-dimensional space, where each point in the space corresponds to a particular color. Two types of color coordinates are of interest for color printing: device independent color coordinates such as CIE (International Commission on Illumination), denoted by the triple (L*,a*,b*) and device specific color coordinates are based on specific colorants, typically cyan (C), magenta (M), yellow (Y), and black (K). In the (L*,a*,b*) coordinate system, L* refers to lightness, a* refers to the level of red or green, and b* refers to the level of blue or yellow. Input images to a printer contain color specifications that are often characterized in terms of (L*,a*,b*) coordinates. Image processing within the printer, referred to as a color rendition dictionary (CRD), transforms these device independent coordinates into the device dependent CMYK coordinates used by the marking process to produce the printed image. The printed image, in turn, is evaluated back in (L*,a*,b*) space using a suitable measurement device such as a calorimeter or a spectrophotometer 115. The color controller 89 attempts to maintain consistent color by making adjustments to the CRD according to colorimeter/spectrophotometer measurements of the printed image. The color controller may be incorporated in the CPU 48, the coupler 80, or elsewhere in the printing system.

While three marking engines 10, 100, 110 are illustrated in FIG. 3 (with a fourth marking engine presently removed) the number of marking engines can be one, two, three, four, five, six, or more. Providing at least two marking engines typically provides enhanced features and capabilities for the printing system 11, since marking tasks can be distributed amongst the at least two marking engines. Some or all of the marking engines 10, 100, 110 may be identical to provide redundancy or improved productivity through parallel printing. Alternatively or additionally, some or all of the marking engines 10, 100, 110 may be different to provide different capabilities. For example, the marking engines 10, 100, may be multicolor, e.g., process color (P) marking engines, while the marking engine 110 may be a monochrome engine, such as a black (K) marking engine. Marking engines 10, 100 may both be adaptable to use the same marking material 32. Thus, if a marking material suited to use in one of the marking engines 10 runs out, a marking material suited to use in the other marking engine 100 may be employed by suitably modifying the marking engine 10. Additionally, all of the marking engines 10, 100 of the same modality (in this case process color) may employ the same marking material. Even though the devices may not be identical, they may be rendered compatible with the same marking material by appropriate modification to the marking engine components of one or more of the marking engines 10, 100. In the case of process color marking engines, it will be appreciated that the marking engines 10, 100 may be rendered compatible for up to four marking materials (cyan, magenta, yellow, and optionally also black).

The print media conveyor 114 is controllable to acquire sheets of a selected print medium from the print media source 28, transfer each acquired sheet to one or more of the installed marking engines 10, 100, 110 to perform selected marking tasks, and then transfer each sheet to the finisher 112 to perform finishing tasks. The illustrated finisher unit 112 includes one or more print media output destinations 116, 118, 120, herein illustrated by trays.

In the illustrated printing system 11, print media which has been printed by one marking engine can be routed to any other marking engine via the conveyor system 114 for duplex printing or overprinting. Additionally, bypass pathways allow one or more of the printers to be bypassed. In other configurations (not shown) the routing may be more limited. While the illustrated marking engines are stacked in a two dimensional configuration, it is also contemplated that a linear arrangement may be employed.

The printing system 11 executes print jobs. Print job execution involves printing images, such as selected text, line graphics, photographs, machine ink character recognition (MICR) notation, and the like on front, back, or front and back sides or pages of one or more sheets of paper or other print media. Some sheets may be left completely blank. Some sheets may have both color and monochrome images. Execution of the print job may also involve collating the sheets in a certain order. Still further, the print job may include folding, stapling, punching holes into, or otherwise physically manipulating or binding the sheets. The printing, finishing, paper handing, and other processing operations that can be executed by the printing system 11 are determined by the capabilities of the paper source 28, marking engines 10, 100, 110, print media conveyor 114, and finisher 112 of the printing system 11.

An image input device supplies the printing system 11 with images to be printed. The image input device can comprise a built-in optical scanner 121, which can be used to scan a document such as book pages, a stack of printed pages, or the like, to create a digital image of the scanned document that is reproduced by printing operations performed by the printing system 11. Alternatively, a print job can be electronically delivered to an interface unit 122 of the printing system 11 via a wired or wireless connection 124 to a digital network 126 that interconnects, for example, personal computers 128, 130 or other digital devices.

The printing system 11 is an illustrative example. In general, any number of print media sources, media handlers, marking engines, collators, finishers or other processing units can be connected together by a suitable print media conveyor configuration. In some embodiments, the printing system may be a cluster of networked or otherwise logically interconnected printers each having its own associated print media source and finishing components.

With particular reference to FIG. 2, the illustrated printing system 11 includes a control system 140 which communicates with the interface unit 121 and CPUs 48 of the marking engines 10, 100, 110. The control system 140 includes a scheduling system 142 which schedules the order of printing of incoming print jobs and identifies a marking engine or marking engines 10, 100, 110 for printing each of the pages of the print jobs. The scheduling system 142 accesses a model of the machine 144 to obtain information on the printing system for scheduling jobs. The model of the machine stores information on the capabilities of each of the marking engines and their current set points and the capabilities of other components of the printing system. A coordinator 146, associated with or integral with the scheduling system 142, communicates with the marking engines 10, 100, 110 and other components 28, 114, 112 of the printing system 11 to coordinate the printing of the print job, including the transportation of the print media to the marking engines and the collation and assembly of print jobs output by the finisher 112 according to a scheduled itinerary. The model of the machine 144 is periodically updated with information on the current states of the marking engines 10, 100, 110 by querying the marking engine CPUs 48 (either directly or via the coordinator 146). The information received by the scheduler 142 may include the current set points of the marking engine components 16, 18, 20, 22, 24, 26 and/or the overall marking engine capabilities, as influenced by the set points. For example, changes to the fuser set points to accommodate a different marking material may influence the maximum output capacity of the marking engine, in terms of prints per minute. This change to a marking engine capability may be relayed to the model of the machine 144.

It will be appreciated that rather than a dedicated coupler 80 for each marking engine 10, 100, 110, a single coupler may be provided for the entire printing system 11 or for a group of marking engines therein. Such a coupler may be incorporated into the printing system control system 140 and communicate with the marking engine CPUs 48 in a similar manner to the scheduling system 142. Additionally, while the illustrated printing system includes at least one reader 86 for each marking engine, it is also contemplated that two or more of the marking engines 10, 100, 110 may share a common reader. Where there is more than one replacement module, more than one reader may be provided, in which case, the replacement module is positioned proximate the appropriate reader. Alternatively, a single reader may be provided for different replacement modules, e.g., a marking engine may include one reader which may read the identifiers for C, M, Y and K marking material cartridges and optionally also the identifiers of other replacement modules, such as photoreceptor belts, fuser rolls, and the like.

Figure 4:
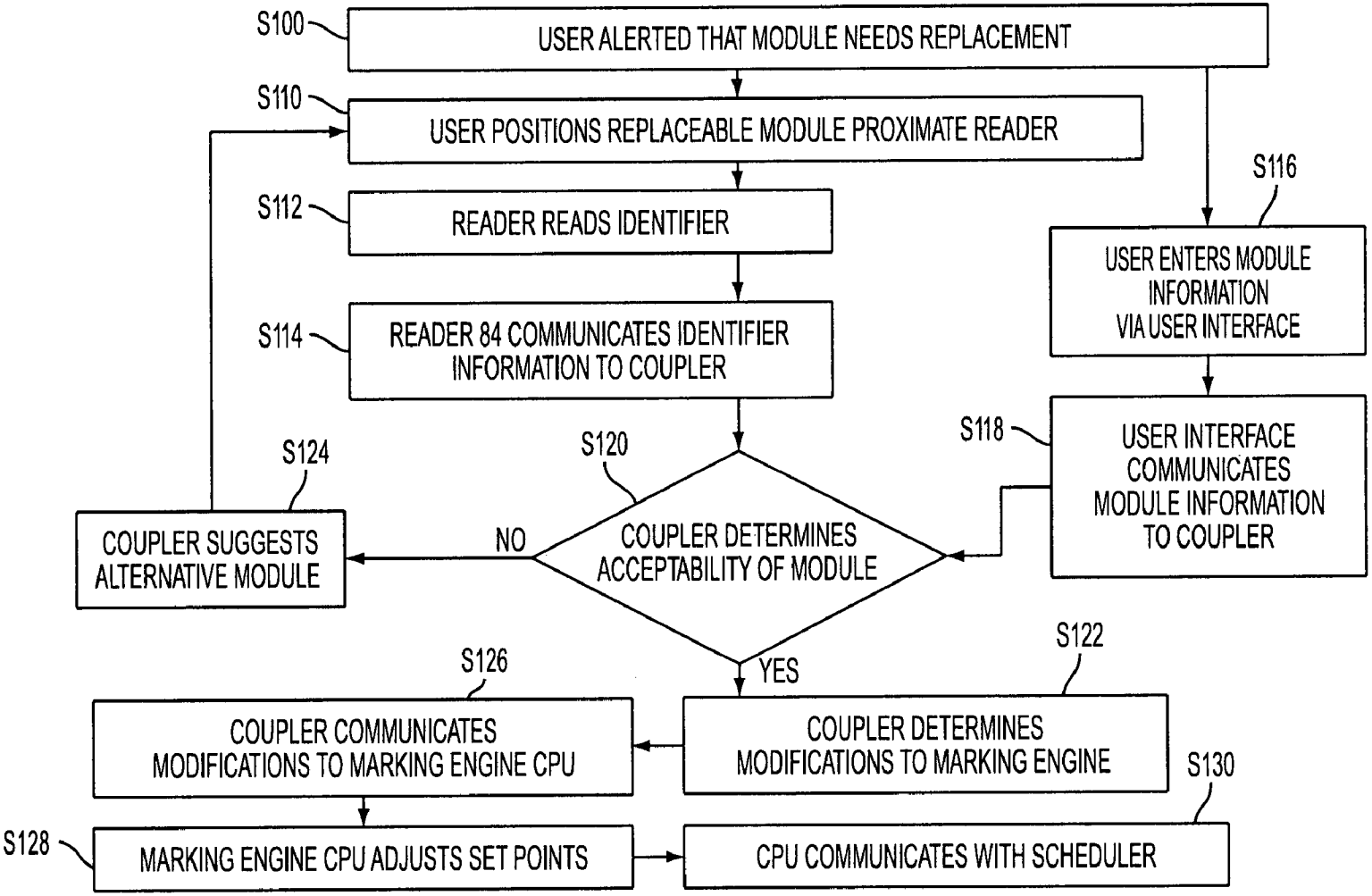
FIG. 4 is a flow diagram of an exemplary process for replacement of a replaceable module in a marking engine.

FIG. 4 shows the steps in an exemplary method of incorporating a replacement module and reconfiguring the marking engine. As will be appreciated, the order of steps is not limited to the order shown and additional steps may be added or fewer than all the steps may be employed. At step S100, a user is alerted, for example, via the user interface 86, that a replacement module, such as the marking material cartridge 38, needs replacement. At step 110, the user positions a replacement module proximate the reader 84 for the marking engine in which the replacement module is to be installed. At step S112, the reader reads the identifier 46 of the replacement module 38. At step S114, the reader 84 communicates the information obtained from the identifier 46 to the coupler 80. Alternatively, at step S116 the user enters information on the replacement module 38 via the user interface 82. At step S118, the user interface 82 communicates the information to the coupler 80. At step S120, the coupler accesses a look up table in memory 90 to determine whether the replacement module is an acceptable module for the marking engine and either accepts or rejects the module. At step S122, if the module has been accepted, the coupler 80 accesses the look up table 90 and determines appropriate settings for the xerographic components 16, 18, 20, 22, 24, 26, and/or the appropriate control algorithms, the appropriate gains for the control algorithms, and the appropriate operational modes for the marking engine. At step S124, if the replacement module is not an acceptable replacement, the coupler, via the user interface 82, may identify an alternative replacement module. At step S126, the coupler communicates the determined set points to the marking engine CPU 48. At step S128, the marking engine CPU makes any appropriate modifications to the set points of the xerographic components. The modifications may take a certain amount of time, depending on the nature of the modifications. During this time (Step S130) the CPU 48 communicates to the scheduler 142 or model of the machine 144 that it is not currently available for printing. The CPU 48 may identify a future time when the modifications will be complete and the marking engine will be ready to resume printing.

The coupler 80 and/or marking engine CPUs 48 may be embodied in any suitable software or hardware. For example, the coupler may be readily implemented in software using object or object-oriented software development environments that provide portable source code that can be used on a variety of hardware platforms. Alternatively, the disclosed coupler may be implemented partially or fully in a hardware using standard logic circuits or VLSI design. Whether software or hardware is used to implement the systems in accordance with the exemplary embodiments is dependent on the speed and/or efficiency requirements of the system, the particular function, and the particular software or hardware systems or microprocessors or microcomputer systems being utilized. The coupler and methods described above, however, can be readily implemented in hardware or software using any suitable systems or structures, devices and/or software by those skilled in the applicable art without undue experimentation from the functional description provided herein together with a general knowledge of the computer arts.

Moreover, the disclosed methods may be readily implemented as software executed on a programmed general purpose computer, a special purpose computer, a microprocessor, or the like. In this case, the methods and systems of the exemplary embodiments described herein can be implemented as a routine embedded on a microprocessor such as Java® or CGI script, as a resource residing on a server or graphics work station, as a routine embedded in a dedicated print management system, web browser, web TV interface, PDA interface, or the like. The coupler and methods for its operation can also be implemented by physically incorporating the system and method into a software and/or hardware system, such as the hardware and software of a graphics workstation or dedicated print management system. In one embodiment, the coupler can be adapted to use with a variety of different printing systems.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A marking engine comprising:

a developer unit which houses a marking material, the developer unit selectively receiving a replacement cartridge containing marking material selected from a plurality of replacement cartridges, the plurality of replacement cartridges comprising:

a first replacement cartridge containing a first marking material which is suitable for most print jobs, and a second replacement cartridge containing a second marking material, formulated differently from the first marking material, for achieving higher print quality than the first marking material;

a marking material identification system which obtains information on the marking material of the selected replacement cartridge;

a first algorithm stored in memory for adjusting the marking engine to accommodate the first marking material;

a second algorithm stored in memory for adjusting the marking engine to accommodate the second marking material; and a first processing component which receives information from the identification system and selects one of the first and second algorithms for rendering the marking engine compatible with the marking material based on information on the marking material received from the identification system.

2. The marking engine of claim 1, wherein the marking material identification system comprises a reader which obtains information from a compatible identifier associated with the cartridge.

3. The marking engine of claim 2, wherein the identifier comprises at least one of the group consisting of a customer replaceable unit monitor (CRUM), a radiofrequency tag, a UPC code, a color code, a detectable chemical marker, a combination thereof, or the like.

4. The marking engine of claim 2, wherein the reader comprises at least one of the group consisting of a customer replaceable unit monitor (CRUM) reader, a radiofrequency detector, a UPC code reader, a bar code reader, a colorimetric sensor, an ultraviolet or infrared sensor, and a chemical sensor.

5. The marking engine of claim 1, wherein the marking material identification system comprises a user input for receiving information on the replaceable cartridge.

6. The marking engine of claim 1, wherein the at least one component comprises at least one of the group consisting of a charging station, an exposure station, the developer unit, a transferring unit, a fuser, and a cleaning device.

7. The marking engine of claim 1, wherein the adjustment to the marking engine is one which results in a change to a set point of at least one marking engine component.

8. The marking engine of claim 1, further comprising a second processing component in communication with the first processing component, the second processing component configured for modifying a set point of at least one of the marking engine components.

9. The marking engine of claim 1, wherein the first processing component determines a modification to at least one of:

a set point of a marking engine component;

an algorithm used to control a set point of a marking engine component; and an operational mode of the marking engine.

10. The marking engine of claim 9, wherein the set point includes at least one of the group consisting of:

a set point for a heated fuser roll of the marking engine;

a set point for a pressure applied between fuser rolls of the marking engine;

a set point for dwell time within a fuser of the marking engine;

a controller gain set point for a charging station controller of the marking engine;

a controller gain set point for a development unit controller of the marking engine;

a controller gain set point for a transfer station controller of the marking engine;

a controller gain set point for a fuser controller of the marking engine;

a controller gain set point for a cleaning device controller of the marking engine;

a charge level set point for a charging station of the marking engine;

an exposure level set point of an exposure station of the marking engine;

a bias potential of a developer unit of the marking engine;

a transfer current set point of a transfer station of the marking engine;

at least one of a cleaning blade force and a bias voltage for a cleaning device of the marking engine;

a toner concentration level for a developer unit of the marking engine;

a controller gain set point for a tone reproduction curve controller of the marking engine; and a controller gain set point for a color controller of the marking engine.

11. The marking engine of claim 9, wherein the set point includes at least one of the group consisting of:

an algorithm for controlling a charging station of the marking engine;

an algorithm for controlling an exposure station of the marking engine;

an algorithm for controlling a developer unit of the marking engine;

an algorithm for controlling a toner concentration level in the developer unit of the marking engine;

an algorithm for controlling a transfer station of the marking engine;

an algorithm for controlling a fuser of the marking engine;

an algorithm for controlling a cleaner station of the marking engine;

an algorithm for controlling tone reproduction curves of the marking engine; and an algorithm for controlling a color produced by the marking engine.

12. The marking engine of claim 9, wherein the set point includes at least one of the group consisting of:

an operational mode for cycling-up the marking engine;

an operational mode for running the marking engine; and an operational mode for cycling-down the marking engine.

13. The marking engine of claim 1, wherein the processing component determines modifications resulting in changes to set points for a plurality of the components of the marking engine.

14. The marking engine of claim 1, wherein the replacement cartridge is selected from a plurality of replacement cartridges, each of the replacement cartridges being compatible with the marking engine, the processing component determining a different adjustment for at least a first of the replacement cartridges from that for at least a second of the replacement cartridges.

15. The marking engine of claim 1, wherein the processing component is configured for evaluating whether a replacement cartridge is incompatible with the marking engine and for recommending an alternative replacement cartridge.

16. A xerographic printing system comprising at least one marking engine according to claim 1.

17. A printing system comprising the marking engine of claim 1 and a second marking engine, the first and second marking engines being capable of using the same replacement cartridge, the first processing component optionally determining, for at least one component of the second marking engine, an appropriate set point for rendering the second marking engine compatible with the marking material based on information on the marking material.

18. The marking engine of claim 1, further comprising:

the marking engine configured for selectively receiving one of a plurality of replacement modules which include the group consisting of:

the first replacement cartridge, the second replacement cartridge, and at least one of:

a third replacement cartridge which includes a third marking material, formulated differently from the first marking material, which enables a print job to be printed at a lower run cost than for the first marking material, and a fourth replacement cartridge which includes a fourth marking material, formulated differently from the first marking material, for performing custom color print jobs.

19. The marking engine of claim 18, wherein for a first of the replacement cartridge, the adjustment determined by the processing component results in a different set point being selected from a set point for a second of the replacement cartridge.

20. The marking engine of claim 18, wherein the adjustment includes at least one of:

an adjustment to a set point of at least one of the components of the marking engine;

an adjustment to an algorithm which results in an adjustment to a set point of at least one of the components of the marking engine; and an adjustment to an operational mode of the marking engine.

21. A method comprising:

establishing an algorithm used to control a set point for a component of a marking engine for each of a plurality of replacement modules, the component set point for each replacement module being selected to render the marking engine compatible with the respective replacement module;

replacing a replaceable module of the marking engine with a selected one of the plurality of replacement modules; and applying the set point for the selected one of the plurality of replacement modules, wherein the plurality of replacement modules include at least two of the group consisting of:

a first replacement module which includes a first marking material which is suitable for most print jobs, a second replacement module which includes a second marking material, formulated differently from the first marking material, for achieving higher print quality than the first marking material, a third replacement module which includes a third marking material, formulated differently from the first marking material, which enables a print job to be printed at a lower run cost than for the first marking material, and a fourth replacement module which includes a fourth marking material, formulated differently from the first marking material, for performing custom color print jobs.

22. The method of claim 21, wherein the method further includes:

reading information from an identifier associated with the selected one of the plurality of replacement modules;

employing the information from the identifier to determine the set point associated with the replacement cartridge.

23. The method of claim 21, further comprising:

identifying an incompatible replacement module; and proposing an alternative replacement module from the plurality of replacement modules.

* * * * *